US009457934B1

(12) United States Patent
Kirkpatrick

(10) Patent No.: US 9,457,934 B1
(45) Date of Patent: Oct. 4, 2016

(54) MUG

(71) Applicant: MAMMOTH MUG INC., Waterloo (CA)

(72) Inventor: Joe Kirkpatrick, Waterloo (CA)

(73) Assignee: MAMMOTH MUG INC., Waterloo, ON ( * ) Notice: Subject to any disclaimer, the term of this patent is extended or adjusted under 35 U.S.C. 154(b) by 0 days.

(21) Appl. No.: 14/990,344

(22) Filed: Jan. 7, 2016

(51) Int. Cl.
*B65D 23/10* (2006.01)
*B65D 25/28* (2006.01)

(52) U.S. Cl.
CPC ..... *B65D 25/2811* (2013.01)

(58) Field of Classification Search
CPC ..... B65D 25/28; B65D 25/2802; B65D 25/2811; B65D 23/10; B65D 23/102; B65D 23/104; B65D 23/106; B65D 23/108
USPC ..... 220/755, 771; 215/398, 384
See application file for complete search history.

(56) References Cited

U.S. PATENT DOCUMENTS

| | | | | |
|---|---|---|---|---|
| D351,312 | S | 10/1994 | Sharon et al. | |
| D375,062 | S | 10/1996 | Cheiky | |
| D387,661 | S | 12/1997 | Adams et al. | |
| 6,059,153 | A * | 5/2000 | Olson | B65D 1/10 222/465.1 |
| D470,014 | S | 2/2003 | Soehnlen | |
| D490,653 | S | 6/2004 | Kleckauskas et al. | |
| D496,222 | S | 9/2004 | Kleckauskas et al. | |
| D574,193 | S | 8/2008 | Galvin | |
| D580,226 | S | 11/2008 | Homma | |
| 7,726,500 | B2 * | 6/2010 | Young | B65D 23/106 215/383 |
| D644,065 | S | 8/2011 | Llerena | |
| D651,854 | S | 1/2012 | Cabados | |
| D656,361 | S | 3/2012 | Gilbert | |
| D658,445 | S | 5/2012 | Carreno | |
| D674,101 | S | 1/2013 | Smith | |
| D683,183 | S | 5/2013 | Dunn et al. | |
| D685,609 | S | 7/2013 | Dunn et al. | |
| D688,520 | S | 8/2013 | Lin | |
| 2003/0173328 | A1 * | 9/2003 | Herckner | B29C 49/04 215/398 |
| 2012/0318767 | A1 * | 12/2012 | Burgess | B65D 1/0207 215/40 |

* cited by examiner

*Primary Examiner* — King M Chu
(74) *Attorney, Agent, or Firm* — Carlson, Gaskey & Olds P.C.

(57) ABSTRACT

A mug includes a lower portion with a base wall and a lower peripheral wall extending upward from a periphery of the base wall. An upper portion includes a shoulder portion tapering upward from an upper peripheral wall extending downward from a periphery of the shoulder portion. A mouth extends upward from an upper end of the shoulder portion. A mid portion connects the upper peripheral wall to the lower peripheral wall. The mid portion includes a constant radius for more than half of a circumference of the mid portion. The constant radius extends from the upper peripheral wall to the lower peripheral wall. The mid portion further includes an upper band adjacent the upper peripheral wall and a lower band adjacent the lower peripheral wall. Each of the upper band and the lower band have the constant radius about their entire circumferences.

19 Claims, 7 Drawing Sheets

MUG

BACKGROUND

There are many different types, sizes and styles of hand-held, reusable beverage containers. Some are plastic, with an integrally-formed handle and a removable, resealable lid.

SUMMARY

A mug according to an example embodiment described herein includes a lower portion with a base wall and a lower peripheral wall extending upward from a periphery of the base wall. An upper portion includes a shoulder portion tapering upward from an upper peripheral wall extending downward from a periphery of the shoulder portion. A mouth extends upward from an upper end of the shoulder portion.

A mid portion connects the upper peripheral wall to the lower peripheral wall. The mid portion includes a constant radius for more than half of a circumference of the mid portion. The constant radius extends from the upper peripheral wall to the lower peripheral wall. The mid portion further includes an upper band adjacent the upper peripheral wall and a lower band adjacent the lower peripheral wall. Each of the upper band and the lower band have the constant radius about their entire circumferences, the mid portion further including a handle recess between the upper band and the lower band, a handle extending vertically across the handle recess from the upper band to the lower band, a handle wall extending across the handle recess and spaced inward from the handle.

DETAILED DESCRIPTION

Figure 1:
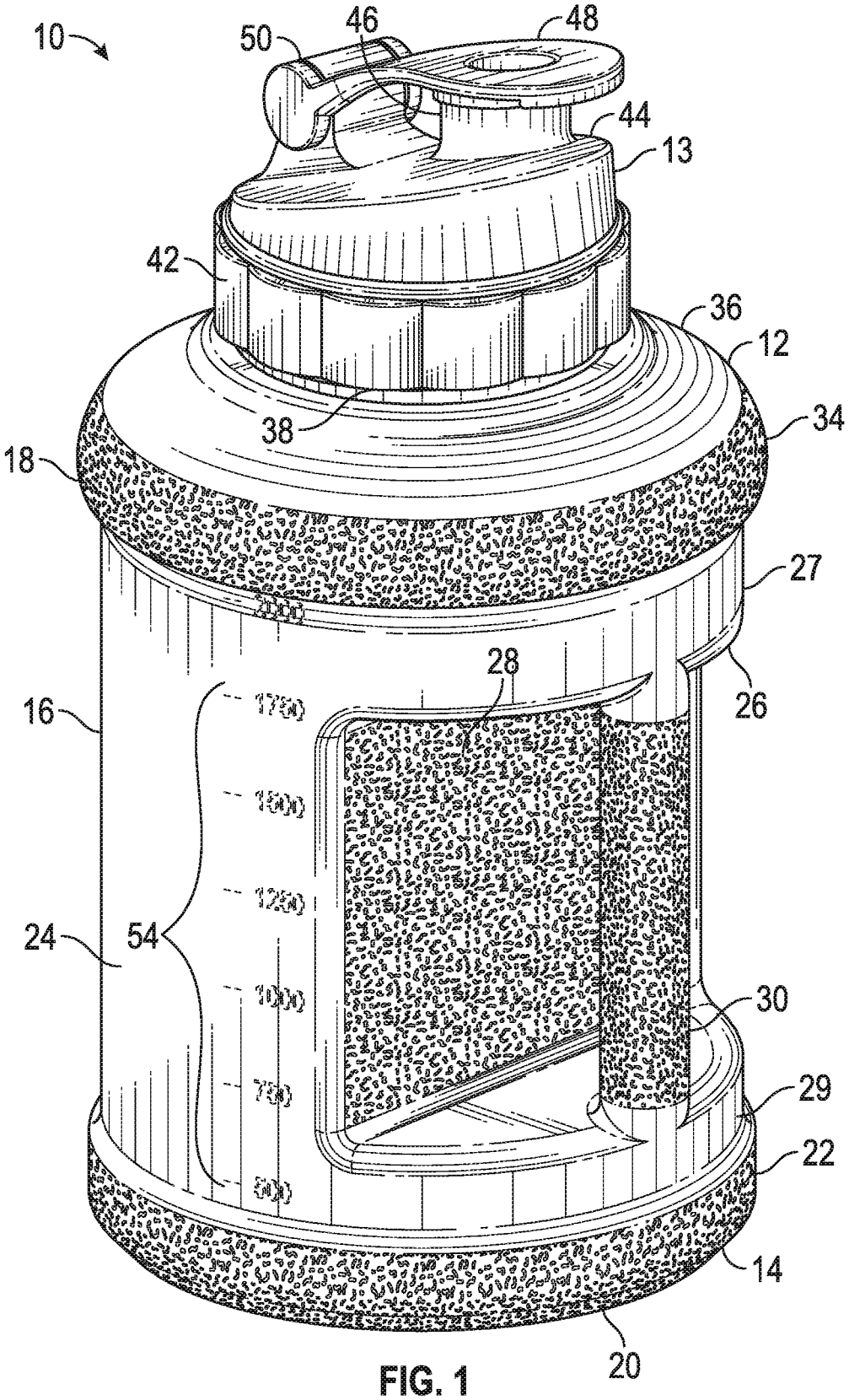
FIG. 1 is a perspective view of a mug in accordance with the present invention.
Figure 2:
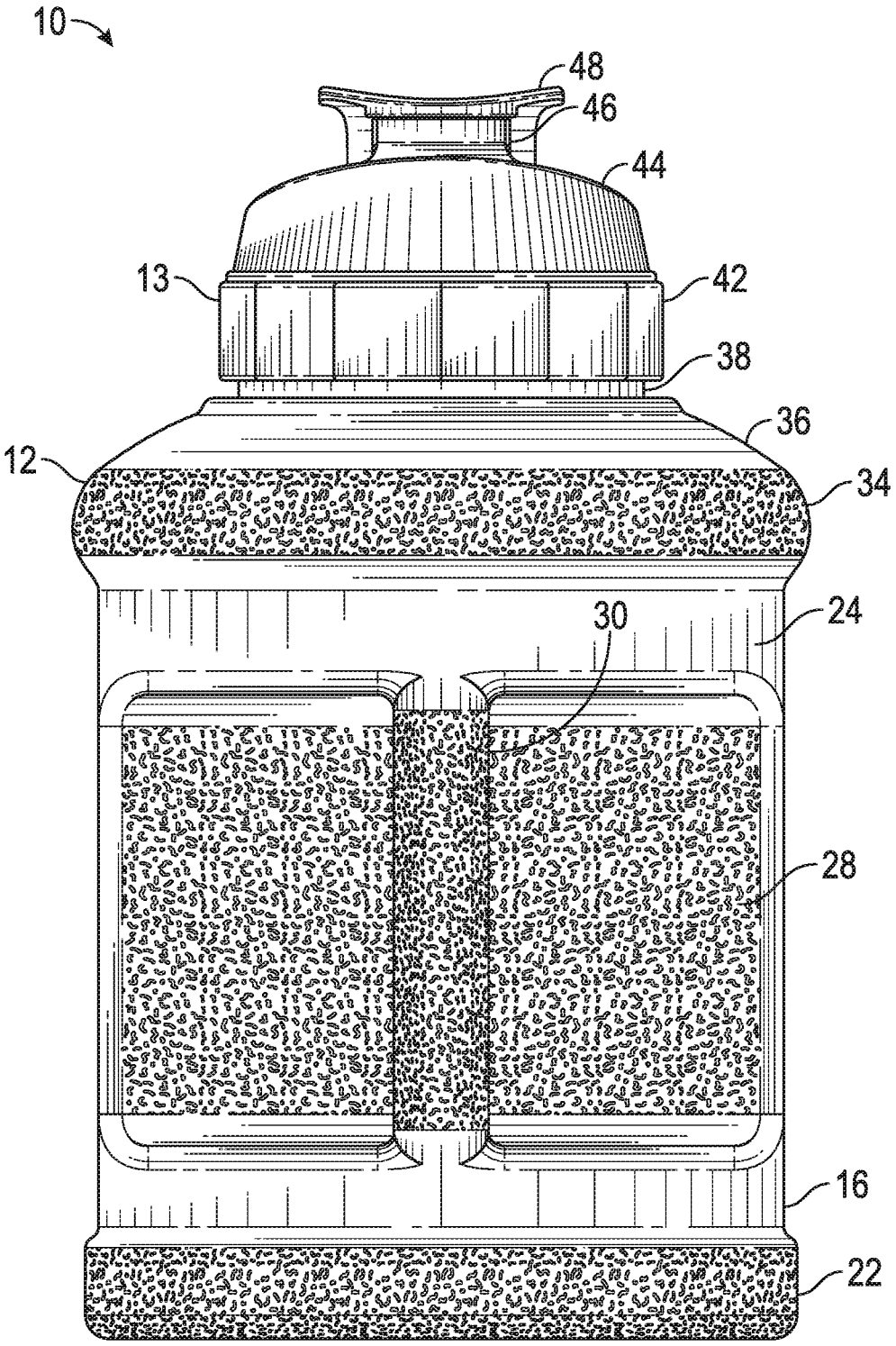
FIG. 2 is a rear view thereof.
Figure 3:
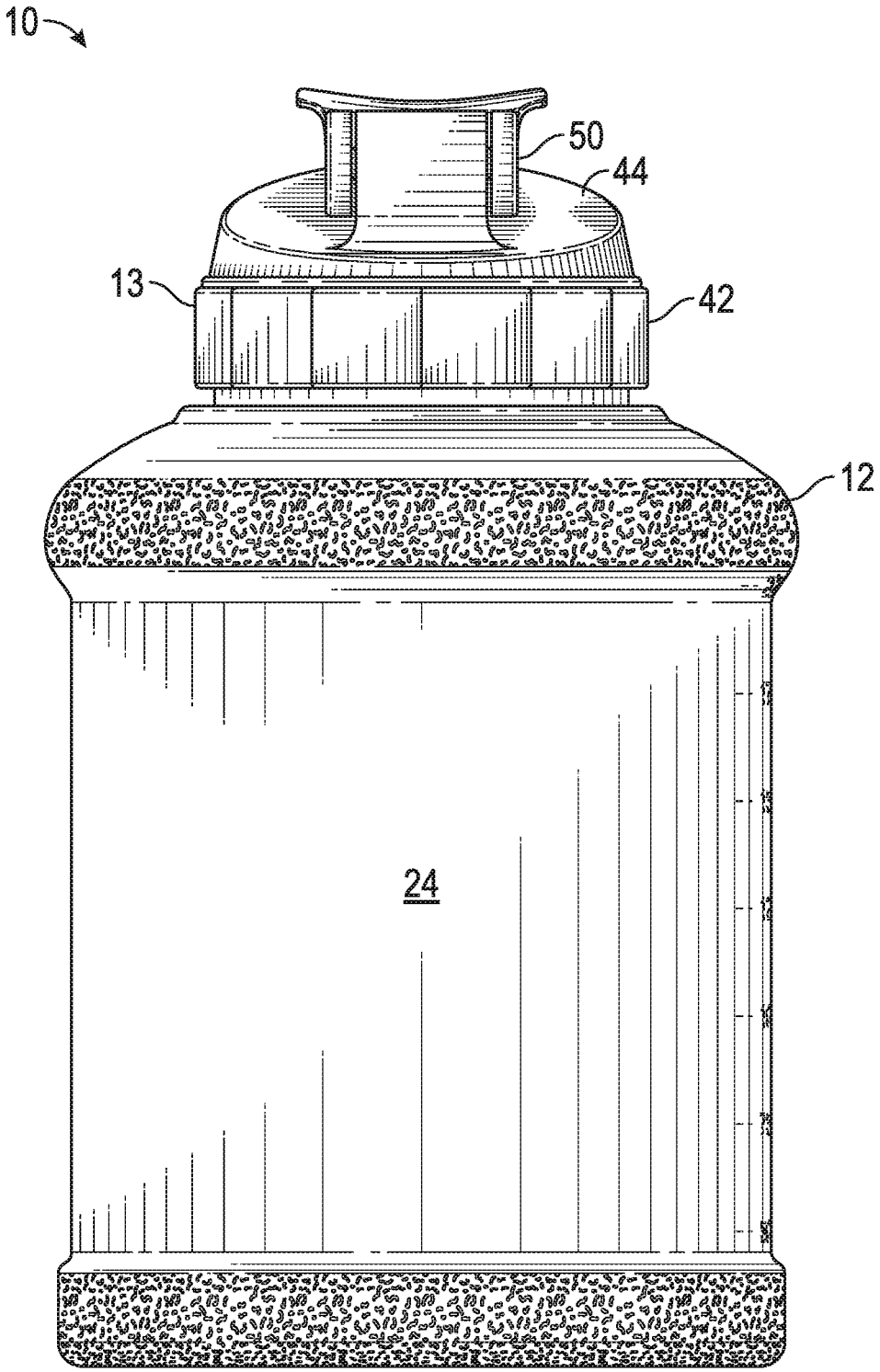
FIG. 3 is a front view thereof.
Figure 4:
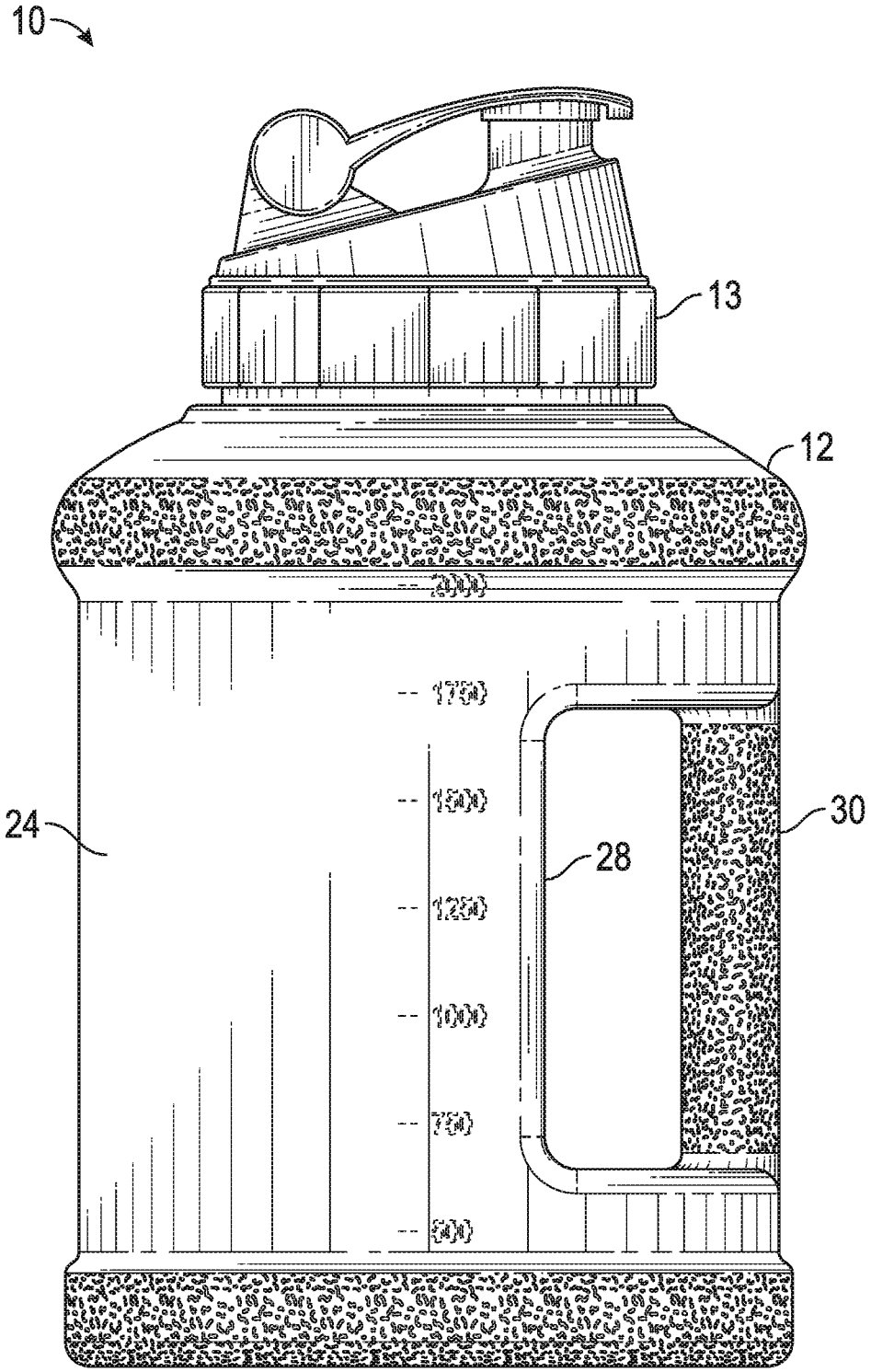
FIG. 4 is a first side view thereof.
Figure 5:
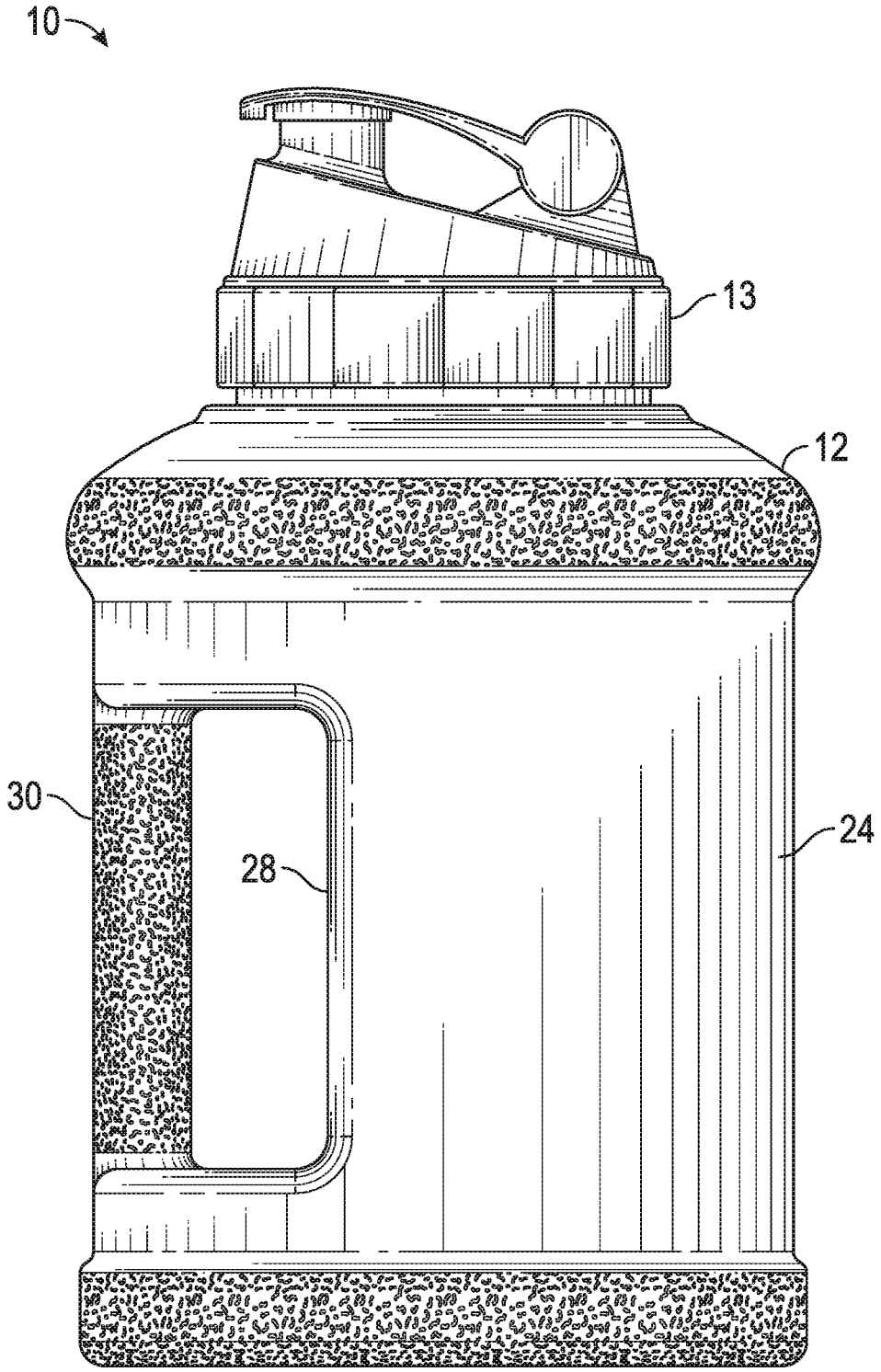
FIG. 5 is a second side view thereof.
Figure 6:
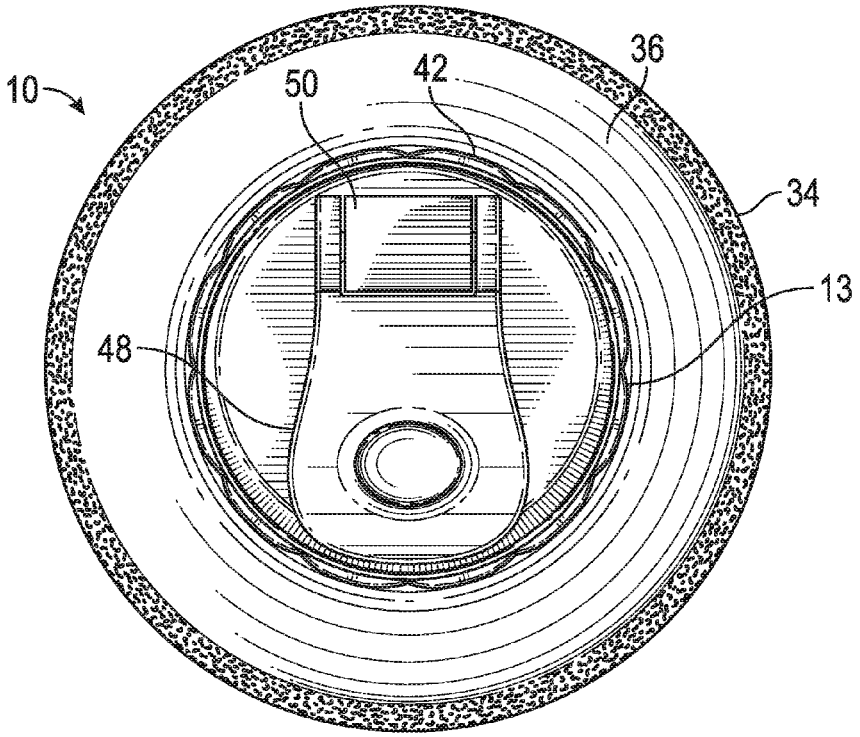
FIG. 6 is a top view thereof.
Figure 7:
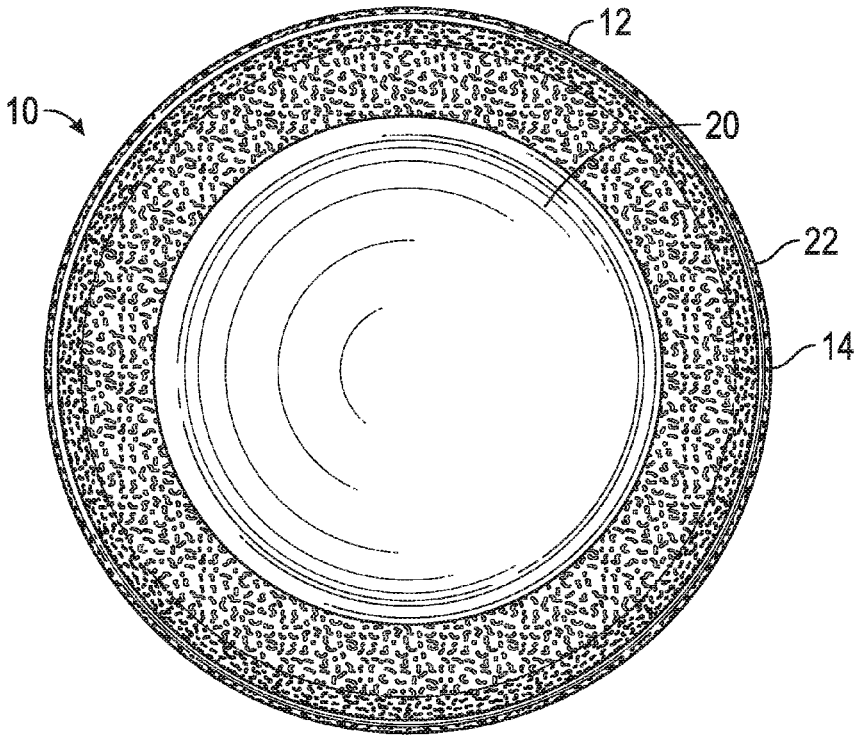
FIG. 7 is a bottom view thereof.
Figure 8:
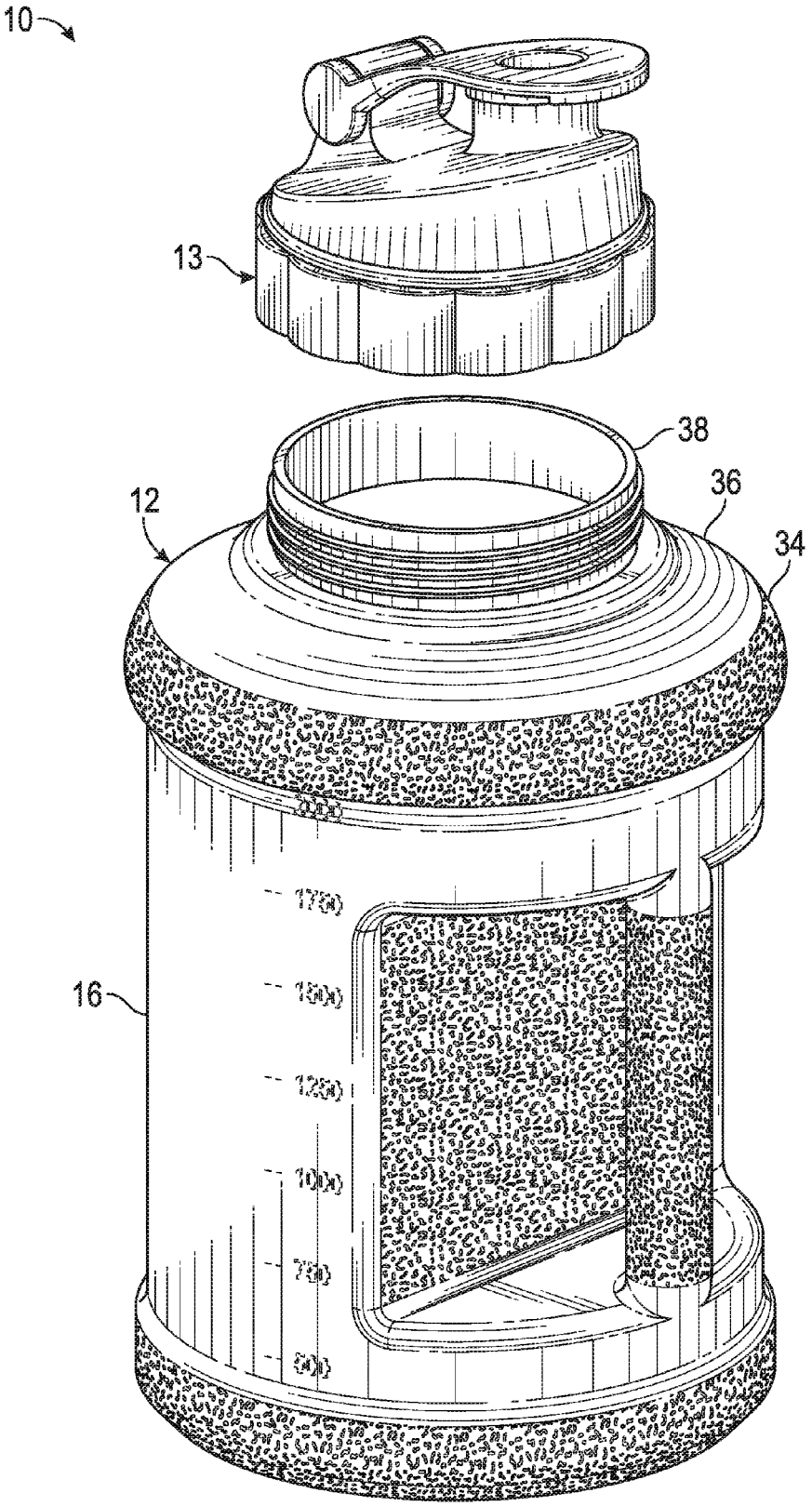
FIG. 8 is an exploded perspective view, showing the lid removed.

A mug 10 according to one example embodiment is shown in FIGS. 1-8. The mug 10 generally includes a body 12 and a lid 13. The body 12 includes a lower portion 14, a mid portion 16 and an upper portion 18. The lower portion 14 includes a base wall 20 and a lower peripheral wall 22 extending upward from a periphery of the base wall 20. The lower peripheral wall 22 may have a texture molded on an outer surface thereof.

The mid portion 16 includes a constant radius portion 24 extending upward from the lower peripheral wall 22. The constant radius portion 24 is approximately 210 degrees of the circumference of the mid portion 16. The mid portion 16 further includes a handle recess 26 formed about the remainder of the circumference of the mid portion 16. A handle wall 28 extends across the handle recess 26. The mid portion 16 further includes an upper band 27 above the handle recess 26 and a lower band 29 below the handle recess 26. The upper band 27 and lower band 29 each have the same constant radius as the constant radius portion 24 of the mid portion 16, such that the complete circumference of the mid portion 16 at the upper band 27 and lower band 29 has a constant radius and constant diameter.

A handle 30 extends vertically across the handle recess 26 from the lower band 29 to the upper band 27. The handle 30 is cylindrical and hollow, such that it is in fluid communication with the remainder of the interior of the body 12 at both upper and lower ends of the handle 30. The handle 30 may have a texture molded on an outer surface thereof, as does the handle wall 28.

The upper portion 18 includes an upper peripheral wall 34 extending downward from a shoulder portion 36 tapering upward to a mouth 38. The upper peripheral wall 34 may be somewhat convex in vertical cross-section and may have a texture molded on an outer surface thereof.

The lid 13 includes a grip portion 42 for threading onto the mouth 38 and an upper wall portion 44 in which an upper opening 46 is formed. A pivoting, sealing cap 48 is connected to the upper wall portion 44 by a hinge 50 and selectively seals the upper opening 46. The lid 13 can be selectively removed by unthreading it from the mouth 38. The mouth 38 has a large diameter, approximately 8.5 cm (3⅜") or larger, to facilitate adding powders, mixes, etc to liquid in the mug 10. The mug 10 may include graduations 54 formed on the constant radius portion 24 of the mid portion 16, so that a user can measure how much fluid is in the mug 10.

The body 12 is molded as a single piece of plastic of a suitable plastic material. The lid 13 may be molded in two pieces, with the cap 48 snap-fit together into the hinge 50.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A mug comprising:

a lower portion including a base wall and a lower peripheral wall extending upward from a periphery of the base wall;

an upper portion including a shoulder portion tapering upward from an upper peripheral wall, the upper peripheral wall extending downward from a periphery of the shoulder portion, a mouth extending upward from an upper end of the shoulder portion, the mouth including external threads formed thereon; and a mid portion connecting the upper peripheral wall to the lower peripheral wall, the mid portion including a constant radius for more than half of a circumference of the mid portion, the constant radius extending from the upper peripheral wall to the lower peripheral wall, the mid portion further including an upper band adjacent the upper peripheral wall and a lower band adjacent the lower peripheral wall, each of the upper band and the lower band having the constant radius about their entire circumferences, the mid portion further including a handle recess between the upper band and the lower band, a handle extending vertically across the handle recess from the upper band to the lower band, a handle wall extending across the handle recess and spaced inward from the handle.

2. The mug of claim 1 wherein the mouth has an inner diameter of at least 8.5 cm (3⅜").

3. The mug of claim 1 wherein the handle is cylindrical.

4. The mug of claim 3 wherein the handle has a texture molded therein.

5. The mug of claim 1 wherein an interior of the handle is fluidly open to an interior of the mug.

6. The mug of claim 1 wherein the mid portion has a maximum diameter less than the upper peripheral wall and the lower peripheral wall.

7. The mug of claim 1 wherein the entire mid portion is recessed relative to the upper peripheral wall and the lower peripheral wall.

8. A mug comprising:

a lower portion including a base wall and a lower peripheral wall extending upward from a periphery of the base wall;

an upper portion including a shoulder portion tapering upward from an upper peripheral wall extending downward from a periphery of the shoulder portion, a mouth extending upward from an upper end of the shoulder portion, wherein the mouth has an inner diameter of at least 8.5 cm (3⅜"); and a mid portion connecting the upper peripheral wall to the lower peripheral wall, the mid portion including a constant radius for more than half of a circumference of the mid portion, the mid portion further including an upper band adjacent the upper peripheral wall and a lower band adjacent the lower peripheral wall, the mid portion further including a handle recess between the upper band and the lower band, a handle extending vertically across the handle recess from the upper band to the lower band, a handle wall extending across the handle recess and spaced inward from the handle, wherein the entire mid portion is recessed relative to the upper peripheral wall and the lower peripheral wall.

9. The mug of claim 8 wherein each of the upper band and the lower band has the constant radius about their entire circumferences.

10. The mug of claim 9 wherein the handle is cylindrical.

11. The mug of claim 9 wherein the handle has a texture molded therein.

12. The mug of claim 9 wherein an interior of the handle is fluidly open to an interior of the mug.

13. The mug of claim 9 wherein the mid portion has a maximum diameter less than the upper peripheral wall and the lower peripheral wall.

14. A mug comprising:

a lower portion including a base wall and a convex lower peripheral wall extending upward from a periphery of the base wall;

an upper portion including a shoulder portion tapering upward from a convex upper peripheral wall, the upper peripheral wall extending downward from a periphery of the shoulder portion, a mouth extending upward from an upper end of the shoulder portion, the mouth including external threads formed thereon; and a mid portion connecting the upper peripheral wall to the lower peripheral wall, the mid portion including a constant radius for more than half of a circumference of the mid portion, the constant radius extending from the upper peripheral wall to the lower peripheral wall, the mid portion further including an upper band adjacent the upper peripheral wall and a lower band adjacent the lower peripheral wall, each of the upper band and the lower band being generally vertical and having the constant radius about their entire circumferences, the constant radius of the upper band and the lower band being less than a radius of the upper peripheral wall and the lower peripheral wall, the mid portion further including a handle recess between the upper band and the lower band, a handle extending vertically across the handle recess from the upper band to the lower band, wherein an interior of the handle is fluidly open to an interior of the mug, a handle wall extending across the handle recess and spaced inward from the handle.

15. The mug of claim 14 wherein the mouth has an inner diameter of at least 8.5 cm (3⅜").

16. The mug of claim 15 wherein the handle is cylindrical.

17. The mug of claim 16 wherein the handle has a texture molded therein.

18. The mug of claim 15 wherein the upper band and the lower band extend about the entire circumference of the mug.

19. The mug of claim 18 wherein the mid portion has a maximum diameter less than the upper peripheral wall and the lower peripheral wall.

* * * * *